US006611091B2

(12) United States Patent
Honmou et al.

(10) Patent No.: US 6,611,091 B2
(45) Date of Patent: Aug. 26, 2003

(54) FLUORESCENT LAMP AND METHOD FOR MANUFACTURING IT

(75) Inventors: Masao Honmou, Okayama (JP); Kazumasa Kobayashi, Okayama (JP); Akihito Wakamiya, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/783,675

(22) Filed: Feb. 14, 2001

(65) Prior Publication Data

US 2001/0013754 A1 Aug. 16, 2001

(30) Foreign Application Priority Data

Feb. 16, 2000 (JP) ..... 2000-037857

(51) Int. Cl.[7] ..... H01J 1/62
(52) U.S. Cl. ..... 313/490; 313/564; 313/565
(58) Field of Search ..... 313/490, 564, 313/565, 562, 549, 550, 556, 572, 577

(56) References Cited

U.S. PATENT DOCUMENTS 5,828,169 A * 10/1998 Myojo et al. ..... 313/562
5,907,216 A * 5/1999 Ligthart et al. ..... 313/564
5,917,276 A * 6/1999 Traksel et al. ..... 313/490
6,337,539 B1 * 1/2002 Yorifuji et al. ..... 315/56

FOREIGN PATENT DOCUMENTS

JP 62-43452 3/1987
JP 63-187531 8/1988

* cited by examiner

*Primary Examiner*—Sandra O'Shea
*Assistant Examiner*—Bao Q. Truong
(74) *Attorney, Agent, or Firm*—Merchant & Gould P.C.

(57) ABSTRACT

A fluorescent lamp has an amalgam container settled inside an exhaust pipe extending from an end portion of a bulb to which electrodes are attached at both end portions. The amalgam container contains amalgam inside and has an opening portion through which the contained amalgam cannot go out and a part for determining the position of the amalgam, wherein the opening portion is located on the side where the exhaust pipe is cut and sealed. This configuration makes it possible to prevent the amalgam from outflowing into an exhaust equipment. In addition, the mercury vapor pressure is maintained optimally, and high luminous efficiency is obtained.

5 Claims, 3 Drawing Sheets

FLUORESCENT LAMP AND METHOD FOR MANUFACTURING IT

FIELD OF THE INVENTION

The present invention relates to a fluorescent lamp and a method for manufacturing it.

BACKGROUND OF THE INVENTION

Conventional fluorescent lamps have amalgam in an arc tube for controlling mercury vapor pressure during its operating. In order to obtain an optimal mercury vapor pressure, this amalgam needed to be placed in an atmosphere with an appropriate temperature.

Therefore, according to a conventional amalgam type fluorescent lamp shown, for example, in JP62(1987)-43452U, an exhaust pipe 22, which extends from an end portion of a bulb 17 and is cut and sealed at its point, contains amalgam 25 and also a glass rod 24 for supporting this amalgam 25 so that the amalgam 25 does not enter a discharge space and for controlling the position of this amalgam 25. This amalgam 25 is located between the glass rod 24 and the point of the exhaust pipe 22.

In manufacturing such a conventional amalgam type fluorescent lamp, if the two elements, i.e. the glass rod 24 and the amalgam 25, are to be contained in an appropriate portion of the exhaust pipe during or after an exhaust process, the exhaust equipment becomes complicated. Furthermore, such the equipment tends to cause unevenness of quality. In order to avoid these problems, a method applied hereto includes the process of positioning the glass rod 24 and the amalgam 25 in the appropriate portion of the exhaust pipe immediately before the exhausting process. In this process, air contained in the bulb is exhausted through the exhaust pipe, then, the lamp is introduced a filler gas, and cut and sealed the appropriate portion of the exhaust pipe. Moreover, in this exhaust process, the bulb is heated in order to exhaust the impure gas efficiently.

However, such a conventional amalgam type fluorescent lamp has the following problems. The amalgam sometimes melts due to the heat applied during the exhaust process or during its operating, and this molten amalgam flows into the space between the exhaust pipe and the glass rod. As a result, the position of the amalgam is shifted from the appropriate location inside the exhaust pipe, thus the lamp loses the luminous efficiency.

Furthermore, another problem is that, in the exhaust process, solid amalgam tends to be drawn into the exhausting equipment. There is also another problem that, when the amalgam melts, a part of mercury contained in the amalgam evaporates, which then is exhausted together with the residual air. As a result, the amount of mercury sealed inside the lamp is reduced to insufficient level.

Moreover, the glass rod placed in the exhaust pipe slows down vacuum pumping speed in the exhaust process because the glass rod also acts as an obstacle. Thus, deterioration of exhaust efficiency becomes remarkable and longer duration of exhaust time is needed.

SUMMARY OF THE INVENTION

It is an object of this invention to avoid the previous problems described above by preventing amalgam outflow into the exhausting equipment in the exhaust process and obtaining high luminous efficiency by maintaining optimal mercury vapor pressure.

Furthermore, it is another object of this invention to provide a method of manufacturing a fluorescent lamp having better working efficiency and exhaust efficiency suppressing the excess reduction of the total mercury amount filled inside a bulb.

The fluorescent lamp of this invention has an amalgam container, which is arranged inside an exhaust pipe extending from an end portion of a bulb to which electrodes are attached at both end portions. The amalgam container contains amalgam inside and has an opening portion through which the contained amalgam cannot go out and stays the amalgam in the proper position. The opening portion of the container is located on the side where the exhaust pipe is cut and sealed.

According to this configuration, in the exhaust process of manufacturing, the amalgam placed inside the bulb cannot flow into an exhaust equipment. In addition, even if the amalgam melts during the exhaust process or during lamp operating, it stays in an appropriate position. As a result, the mercury vapor pressure inside the bulb is maintained optimally during lamp operating.

In the fluorescent lamp of the above configuration, it is better that a maximum distance between the amalgam container and the inside of the exhaust pipe is in the range between 0.1 mm and 2.0 mm. Because, at the start of operation, the mercury vapor should be released smoothly from the amalgam container into a discharge space. At the same time, breakage of the exhaust pipe is prevented because the amalgam container does not bump into the exhaust pipe during the transportation of the lamps and so forth.

Furthermore, in the fluorescent lamp of the above configuration, it is better that a distance between the amalgam and the electrode is in the range between 20 mm and 50 mm. Thereby, during lamp operating, the mercury vapor is supplied appropriately by the amalgam, so that the mercury vapor pressure inside the bulb is controlled optimally.

Moreover, in the fluorescent lamp of the above configuration, it is more better that the amalgam container has a through hole for connecting a space where the amalgam is contained and a discharge space. Thereby, at the start of operation, the mercury vapor is released more smoothly from the amalgam container into the discharge space.

The method for manufacturing the fluorescent lamp of this invention is for any one of the fluorescent lamps mentioned above, including (a) exhausting air inside the bulb and (b) cutting and sealing an appropriate portion of the exhaust pipe after the step (a), wherein the amalgam container containing the amalgam is settled in the appropriate portion of the exhaust pipe at a point of change from the step (a) to the step (b).

Due to this configuration, it is no longer necessary to settle a glass rod and an amalgam separately in the appropriate portion of the exhaust pipe as before. Therefore, working efficiency is improved without making the exhaust equipment complicated. Furthermore, in the exhausting step (a), there is nothing inside the exhaust pipe, therefore, the exhaust efficiency is improved. Moreover, the amalgam is not affected by heat during the exhausting step (a). In other words, the mercury does not evaporate from the amalgam during the exhausting step (a), and the mercury vapor is not exhausted together with the residual gas. As a result, the excess reduction of the total mercury amount filled inside the bulb is suppressed.

In the method mentioned above, it is more better that, after the amalgam container is settled in the exhaust pipe, the exhaust pipe should be cut and sealed within 30 seconds. By this, the thermal effect on the amalgam is reduced, and the excess reduction of the total mercury amount filled inside the bulb is suppressed even more.

DESCRIPTION OF THE PREFERRED EMBODIMENTS

Embodiment 1

Figure 1:
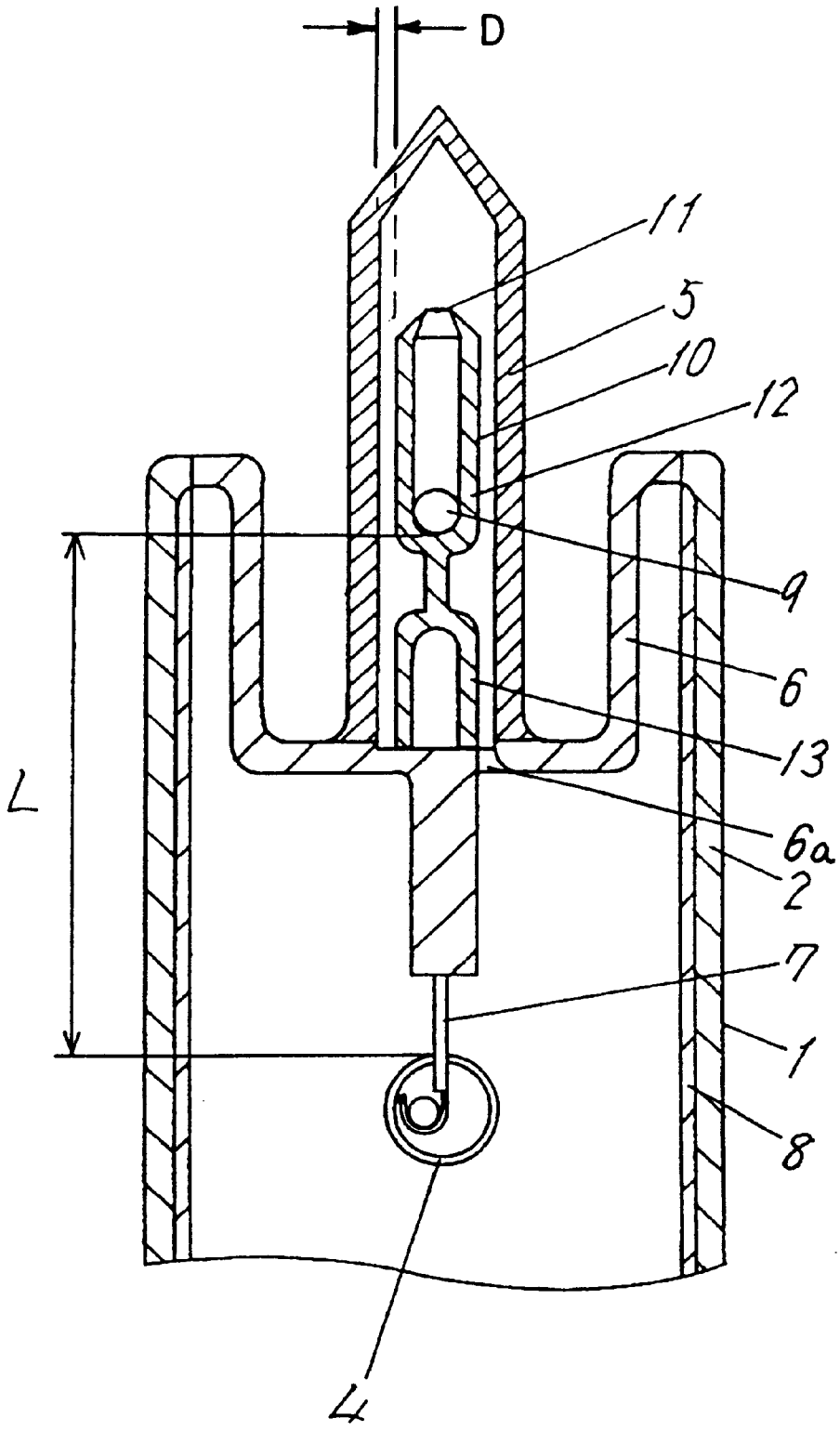
FIG. 1 is an enlarged sectional view showing the relevant portion of a fluorescent lamp according to Embodiment 1 of this invention.
Figure 2:
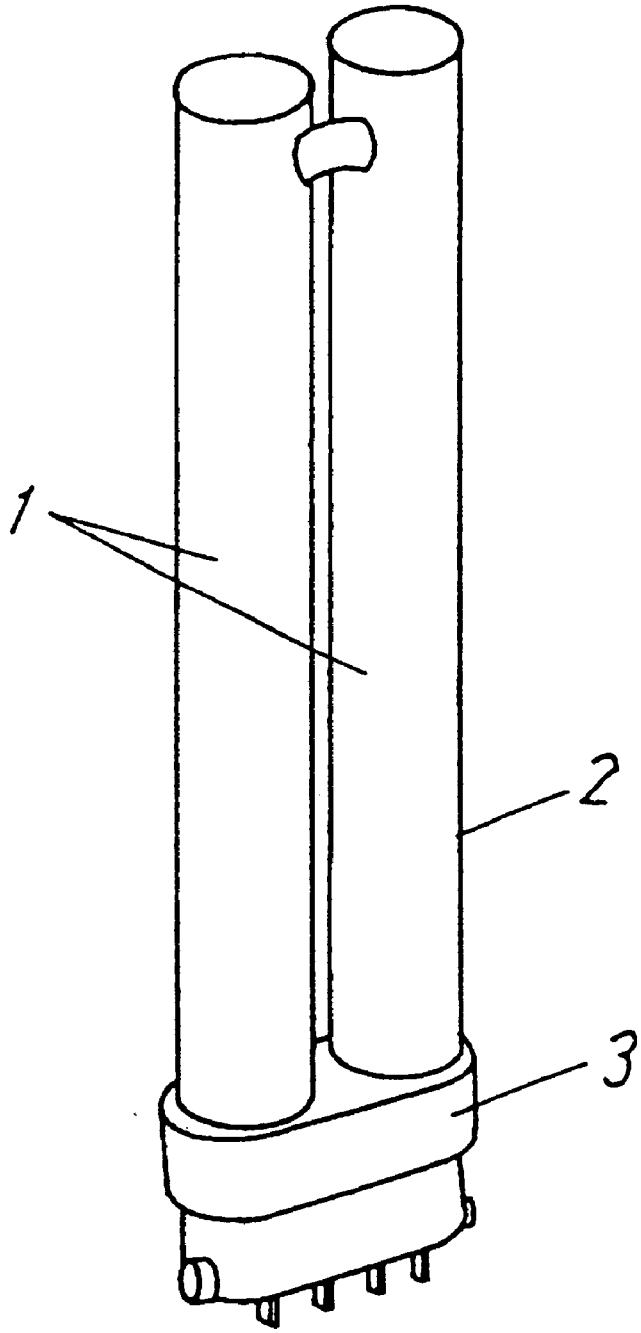
FIG. 2 is a perspective view of the fluorescent lamp.

With reference to FIG. 1 and FIG. 2, a single base fluorescent lamp for high frequency operation of 32 W rated power and 5000K correlated color temperature is explained as Embodiment 1 of this invention. This lamp has, as illustrated in FIG. 2, a bulb 2 of 400 mm in full length and a base 3 attached at the end portions of the bulb 2, and the bulb 2 is composed of two pieces of glass tubes 1 interconnected by a bridge having one discharge path formed inside. Inside the bulb 2, a predetermined amount of a mixed gas of argon and neon (hereinafter referred to as a filler gas) is contained.

To both end portions of the bulb 2, as illustrated in FIG. 1 (only one end portion is shown), a stem 6 having a coiled electrode 4 and an exhaust pipe 5 with 5 mm in inner diameter is attached. The exhaust pipe 5 is extending from the end portion of the bulb 2. In FIG. 1, an interior lead wire 7 for supporting the electrode 4, and a phosphor coating 8 are shown. The interior lead wire 7 is connected to an exterior lead wire (not shown). The stem 6 has a through hole 6*a* through which the inside of the bulb 2 is connected with the inside of the exhaust pipe 5.

The other end portion of the bulb 2 has the same structure as illustrated in FIG. 1 except amalgam 9 and an amalgam container 10.

Inside the exhaust pipe 5, as illustrated in FIG. 1, the amalgam container 10 with 15.5 mm in full length containing the amalgam 9 is settled. This amalgam container 10 has an opening portion 11 at one of its end, and this opening portion 11 is located on the side where the exhaust pipe 5 is cut and sealed. The amalgam container 10 has an amalgam containing portion 12 of 2.5 mm in maximum inner diameter where the amalgam 9 is settled. Furthermore, on the side of the other end portion of the amalgam container 10, a Y-shaped leg portion 13 of 10 mm in length is formed as means to control the position of the amalgam 9.

With regard to materials of the amalgam container 10, for example, glass such as soda glass or metals that do not react with mercury, i.e. iron, should be used.

The opening portion 11 has, for example, a diameter of 2.0 mm, which is a size through which the contained solid amalgam 9 cannot go out.

The leg portion 13 is formed to control the position of the amalgam 9 inside the exhaust pipe 5. With the length of this leg portion, the amalgam is maintained with an optimal temperature, and mercury vapor pressure inside the bulb 2 is optimized.

The amalgam 9 is made of an alloy of mercury and zinc (50:50 in weight ratio). It is a spherical grain with 2.4 mm in original diameter.

The following are explanations of a method for manufacturing such a single base fluorescent lamp.

The amalgam container 10 is manufactured as follows. First, the amalgam containing portion 12 and the leg portion 13 are formed. Next, the amalgam 9 is placed inside the amalgam containing portion 12. Then, the opening end of the amalgam containing portion 12 is narrowed, for example, by pinching or the like to form the opening portion 11. In this way, the amalgam container 10 is completed.

According to the manufacturing process of the fluorescent lamp using the amalgam container 10, first of all, the stem 6 having the electrode 4 and the exhaust pipe is attached to the both end portions of the bulb 2 by welding. From the exhaust pipe, air contained in the bulb 2 is exhausted (hereinafter referred to as an exhausting process). Immediately after this exhausting process, the amalgam container 10 containing the amalgam 9 is settled in the appropriate portion of the exhaust pipe. Then, a filler gas is introduced inside, and the exhaust pipe is cut and sealed. In this way, the exhaust pipe 5 as illustrated is formed.

Thereafter, the base 3 is attached to the end portions of the bulb 2. As a result, the single base fluorescent lamp is manufactured.

As mentioned above, the feature of the fluorescent lamp of this invention is that the amalgam container 10, which contains the amalgam 9 inside and has the opening portion 11 through which the amalgam 9 cannot go out and the leg portion 13 for controlling the position of the amalgam, is settled inside the exhaust pipe 5 in such a manner that the opening portion 11 is located on the side where the exhaust pipe 5 is cut and sealed. Accordingly, in the exhausting process of the manufacturing, the amalgam 9 settled inside the bulb is prevented from outflowing into the exhausting equipment. In addition, even if the amalgam 9 melts due to the heat applied during the exhaust process or during lamp operating, the amalgam 9 stays in the appropriate position. As a result, the mercury vapor pressure inside the bulb 2 is maintained optimally during lamp operating, and high luminous efficiency is obtained.

Furthermore, the feature of the method for manufacturing the fluorescent lamp of this invention is that the method includes the process of exhausting air contained in the bulb and cutting and sealing the appropriate portion of the exhaust pipe after the exhaust process, wherein the amalgam container 10 containing the amalgam 9 is mounted at the appropriate portion of the exhaust pipe at a point of change from the exhaust step to the cutting and sealing step of the exhaust pipe. Due to this method, it is no longer necessary to settle a glass rod and an amalgam separately in the appropriate portion of the exhaust pipe as before. Therefore, working efficiency is improved without making the exhaust equipment complicated. Furthermore, in the exhausting step, since the amalgam container 10 is not positioned in the exhaust pipe, that is, there is nothing in the exhaust pipe, the exhaust efficiency is improved. Moreover, the amalgam 9 is not affected by heat in the exhausting step. In other words, the mercury does not evaporate from the amalgam 9 during the exhausting step, and the mercury vapor is not exhausted together with the residual gas. As a result, the excess reduction of the total mercury amount filled inside the bulb 2 is suppressed.

In the manufacturing method of the fluorescent lamp mentioned above, it is more better that, after the amalgam container 10 is settled in the exhaust pipe, the exhaust pipe should be cut and sealed within 30 seconds. Thereby, the thermal effect on the amalgam 9 is reduced. As a result, the mercury amount contained in the amalgam 9 after the exhaust pipe is cut and sealed is maintained to be of such an amount that the luminous flux of the lamp is not affected practically, that is, to be at least 70% of the original mercury amount. Thus, the excess reduction of the total mercury amount is suppressed even more.

Moreover, it is better that a maximum distance between the exhaust pipe 5 and the amalgam container 10 is in the range between 0.1 mm and 2.0 mm.

When the maximum distance between the exhaust pipe and the amalgam container is less than 0.1 mm, the space between the exhaust pipe and the amalgam container is so narrow that the mercury vapor evaporated from the amalgam does not pass through smoothly into the discharge space, and thus, warm-up characteristics of the lamp are deteriorated. Furthermore, when the maximum distance between the exhaust pipe 5 and the amalgam container 10 is more than 2.0 mm, for example, the amalgam container bumps into the exhaust pipe strongly during the transportation of the lamps and so forth, so that the exhaust pipe is broken and the leakage of the lamp occurs.

Therefore, by determining the maximum distance between the exhaust pipe 5 and the amalgam container 10 to be in the range between 0.1 mm and 2.0 mm, at the warm-up of the lamp, the mercury vapor evaporated from the amalgam 9 is released smoothly into the discharge space by passing through the space between the exhaust pipe 5 and the amalgam container 10, so that excellent warm-up characteristics of the lamp are obtained. At the same time, the occurrence of the lamp leakage due to the breakage of the exhaust pipe 5 is prevented.

Furthermore, it is better that a distance L (See FIG. 1) between the amalgam 9 and the electrode 4 is determined to be in the range between 20 mm and 50 mm. Thereby, during lamp operating, the mercury vapor is supplied appropriately by the amalgam 9, so that the mercury vapor pressure inside the bulb 2 is controlled optimally, and high luminous efficiency is obtained.

On the other hand, when the distance L is less than 20 mm, the luminous flux of the lamp is reduced, and the luminous efficiency is deteriorated. This is due to the fact that the temperature of the amalgam is risen too much by the heat from the electrode, and that the mercury vapor is released excessively into the discharge space. When the distance L is more than 50 mm, the luminous flux of the lamp is reduced, and the luminous efficiency was deteriorated. This is due to the fact that the temperature of the amalgam became too low because the distance from the electrode is too far to conduct the heat, and that the mercury vapor is released insufficiently into the discharge space.

Embodiment 2

Figure 3:
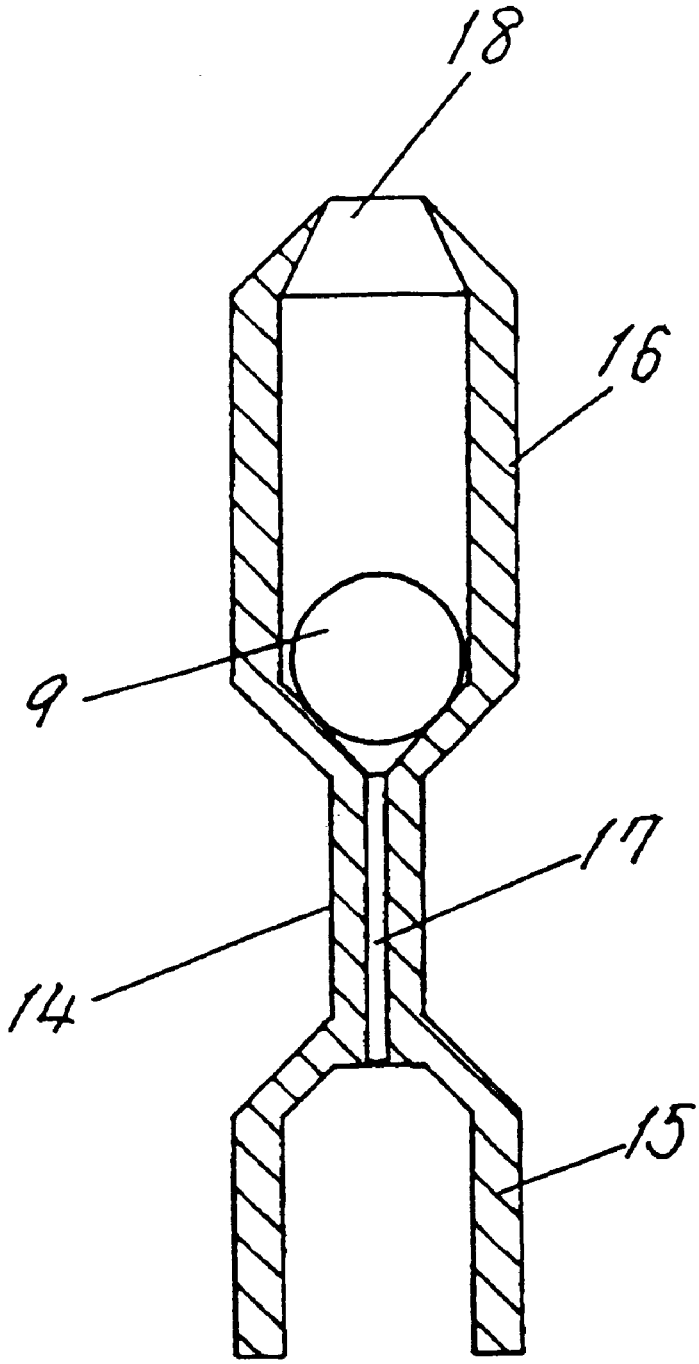
FIG. 3 is a frontal sectional view showing an amalgam container used for a fluorescent lamp of Embodiment 2 of this invention.

With reference to FIG. 3, a single base fluorescent lamp for high frequency operation of 32 W rated power and 5000K correlated color temperature is explained as Embodiment 2 of this invention. This lamp has the same structure as Embodiment 1 except that the structure of an amalgam container 14 is shown in FIG. 3. This amalgam container 14 has a through hole 17 for connecting an amalgam containing portion 16 and a discharge space. In FIG. 3, an opening portion 18 of the amalgam container 14 is shown.

The through hole 17 is determined to have a large diameter through which mercury vapor can pass through and also to have such a diameter that the solid or molten amalgam 9 does not flow through, for example, 0.1 mm.

As mentioned above, the through hole 17 for connecting the space where the amalgam 9 is contained and the discharge space exists, so that the mercury vapor is released even more smoothly into the discharge space. As a result, warm-up characteristics of the lamp are improved even more.

Additionally, in Embodiment 1 and Embodiment 2 mentioned above, it is better that the end portions of the amalgam containers 10, 14 are not angular but round in shape in order to prevent the throwing device of the amalgam containers 10, 14 from breaking.

Furthermore, in Embodiment 1 and Embodiment 2 mentioned above, the amalgam 9 is explained by referring to the case in which the alloy of mercury and zinc is used, but it is not limited hereto. For example, as to the amalgam 9, it should be an alloy made of mercury and at least one kind of material selected from zinc, lead, tin, bismuth, indium and the like.

Furthermore, in Embodiment 1 and Embodiment 2 mentioned above, the leg portions 13, 15 are explained by referring to the case in which the Y-shaped sectional leg portion is used. However, any shape, for example, a simple rod is available to determine the positions of the amalgam containers 10, 14 inside the exhaust pipe 5 if it gives the same effect mentioned above.

Moreover, Embodiment 1 and Embodiment 2 are explained by using the single base fluorescent lamp for high frequency operation of 32W rated power and 5000K correlated color temperature, in which two pieces of glass tubes 1 are interconnected by a bridge, but it is not limited hereto. For example, in the case of a single base fluorescent lamp for high frequency operation in which four pieces of glass tubes 1 are interconnected by bridges, and in the another case of a single base fluorescent lamp for high frequency operation having a U-shaped bulb, or a self-ballasted compact fluorescent lamp, the same effect mentioned above is obtained by applying this invention.

As mentioned above, according to the fluorescent lamp of this invention, in the exhausting process of the manufacturing, the amalgam settled inside the bulb is prevented from outflowing into the exhaust equipment. In addition, even if the amalgam melts during the exhausting process or during lamp operating, the amalgam stays in the appropriate position. As a result, the mercury vapor pressure inside the bulb is maintained optimally during lamp operating, and high luminous efficiency is obtained.

Furthermore, according to the method for manufacturing the fluorescent lamp of this invention, the working efficiency is improved without making the exhaust equipment complicated, and the excess reduction of the total mercury amount filled inside the bulb is suppressed.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A fluorescent lamp comprising an amalgam container, which is settled inside an exhaust pipe extending from an end portion of a bulb to which electrodes are attached at both end portions, the amalgam container containing amalgam inside and having an opening portion through which the amalgam cannot go out and a part for determining the position of the amalgam, wherein the opening portion is located on the side where the exhaust pipe is cut and sealed and a distance between the amalgam and the electrode is in the range between 20 mm and 50 mm.

2. The fluorescent lamp according to claim 1, wherein a maximum distance between the amalgam container and the exhaust pipe is in the range between 0.1 mm and 2.0 mm.

3. The fluorescent lamp according to claim 1, wherein the amalgam container has a through hole for connecting a space where the amalgam is contained and a discharge space.

4. A method for manufacturing a fluorescent lamp having an amalgam container, which is settled inside an exhaust pipe extending from an end portion of a bulb to which electrodes are attached at both end portions, the amalgam container containing amalgam inside and having an opening portion through which the amalgam cannot go out and a part for determining the position of the amalgam, wherein the opening portion is located on the side where the exhaust pipe is cut and sealed and a distance between the amalgam and the electrode is in the range between 20 mm and 50 mm, the method comprising (a) exhausting air contained in the bulb and (b) cutting and sealing the exhaust pipe after the step (a), wherein the amalgam container containing the amalgam is settled in the exhaust pipe at a point of change from the step (a) to the step (b), and the amalgam container is provided with the opening portion before it is settled in the exhaust pipe.

5. The method for manufacturing a fluorescent lamp according to claim 4, wherein, after the amalgam container is settled in the appropriate portion of the exhaust pipe, the exhaust pipe should be cut and sealed within 30 seconds.

* * * * *